US010974803B2

(12) United States Patent
Tsutsui

(10) Patent No.: US 10,974,803 B2
(45) Date of Patent: Apr. 13, 2021

(54) STEERING DEVICE AND WATERCRAFT STEERING DEVICE

(71) Applicant: Showa Corporation, Gyoda (JP)

(72) Inventor: Hayato Tsutsui, Fukuroi (JP)

(73) Assignee: Showa Corporation, Gyoda (JP)

( * ) Notice: Subject to any disclaimer, the term of this patent is extended or adjusted under 35 U.S.C. 154(b) by 0 days.

(21) Appl. No.: 16/567,640

(22) Filed: Sep. 11, 2019

(65) Prior Publication Data

US 2020/0361586 A1 Nov. 19, 2020

(30) Foreign Application Priority Data

May 14, 2019 (JP) ..... JP2019-091620

(51) Int. Cl.

| | |
|---|---|
| ***B63H 21/00*** | (2006.01) |
| ***B63H 20/12*** | (2006.01) |
| ***B63H 25/30*** | (2006.01) |
| ***B63H 20/00*** | (2006.01) |

(52) U.S. Cl.

CPC ..... *B63H 21/265* (2013.01); *B63H 20/12* (2013.01); *B63H 25/30* (2013.01)

(58) Field of Classification Search

CPC ..... B63H 20/00; B63H 20/08; B63H 25/00; B63H 25/42; B63H 20/12; B63H 21/00; B63H 21/265; B63H 25/30; B66F 9/20; B66F 9/22

USPC ..... 440/61 R, 61 S

See application file for complete search history.

(56) References Cited

U.S. PATENT DOCUMENTS

| | | | | |
|---|---|---|---|---|
| 5,505,641 | A | 4/1996 | Onoue | |
| 6,790,110 | B2 * | 9/2004 | Ozawa | B63H 25/30 440/61 S |
| 2003/0186600 | A1 | 10/2003 | Ozawa | |
| 2011/0282551 | A1 * | 11/2011 | Sasaki | B62D 5/064 701/42 |

FOREIGN PATENT DOCUMENTS

| | | | |
|---|---|---|---|
| JP | 61-105297 | A | 5/1986 |
| JP | 06-127475 | A | 5/1994 |
| JP | 07-002606 | U | 1/1995 |
| JP | 10-061617 | A | 3/1998 |

(Continued)

OTHER PUBLICATIONS

Japanese Office Action dated Jan. 28, 2020 for the corresponding Japanese Patent Application No. 2019-091620.

*Primary Examiner* — Lars A Olson

(74) *Attorney, Agent, or Firm* — Leason Ellis LLP

(57) ABSTRACT

A steering device includes: a cylinder; a normal/reverse rotation type hydraulic power source; an oil storage tank; a first oil passage that connects the cylinder with the hydraulic power source; a second oil passage that connects the cylinder with the hydraulic power source; an oil passage group that includes at least one oil passage connecting at least one of the first oil passage and the second oil passage with the oil storage tank; and a changeover valve group that performs changeover between a state in which hydraulic oil recovered from the cylinder flows back to the oil storage tank and a state in which hydraulic oil supplied from the hydraulic power source to the cylinder does not flow back to the oil storage tank, in accordance with a state of hydraulic oil supplied by the hydraulic power source.

14 Claims, 9 Drawing Sheets

(56) References Cited

FOREIGN PATENT DOCUMENTS

| | | | |
|---|---|---|---|
| JP | 10-220412 | A | 8/1998 |
| JP | 2000-009101 | A | 1/2000 |
| JP | 2001-349303 | A | 12/2001 |
| JP | 2003-285797 | A | 10/2003 |
| JP | 2015-178860 | A | 10/2015 |

* cited by examiner

STEERING DEVICE AND WATERCRAFT STEERING DEVICE

CROSS-REFERENCE TO RELATED APPLICATIONS

This application is based upon and claims the benefit of priority to Japanese patent application No. 2019-091620, filed on May 14, 2019, the entire contents of which are incorporated herein by reference.

TECHNICAL FIELD

The present invention relates to a steering device and a watercraft steering device.

BACKGROUND ART

In the related art, steering devices are available and used in various fields. For example, a power tilt and power steering device provided with a power tilt hydraulic cylinder for tilting up/down an outboard motor body of an outboard motor and a power steering hydraulic cylinder swinging the outboard motor body of the outboard motor has been disclosed in JP-A-6-127475.

The cylinder device having a configuration which uses a normal/reverse rotation type hydraulic power source is available in the related art. By use of the normal/reverse rotation type hydraulic power source, there is a merit that complication of an oil-hydraulic circuit can be suppressed.

On the other hand, when the normal/reverse rotation type hydraulic power source is used, it is difficult to replace hydraulic oil in the oil-hydraulic circuit with oil in a tank. Accordingly, there is a defect that foreign matters are apt to stay in the hydraulic oil. This may cause a problem that the hydraulic oil deteriorates or an operating characteristic of the hydraulic oil changes.

An object of the present disclosure is to materialize a steering device etc. which can suitably replace hydraulic oil in an oil-hydraulic circuit with oil in a tank in a configuration using a normal/reverse rotation type hydraulic power source.

SUMMARY OF INVENTION

According to an aspect of the present disclosure, there is provided a steering device including: a cylinder; a normal/reverse rotation type hydraulic power source that is provided with a first discharge port and a second discharge port; an oil storage tank; a first oil passage that connects a first chamber of the cylinder with the first discharge port of the hydraulic power source; a second oil passage that connects a second chamber of the cylinder with the second discharge port of the hydraulic power source; an oil passage group that includes an oil passage or a plurality of oil passages connecting at least one of the first oil passage and the second oil passage with the oil storage tank; and a changeover valve group that includes a changeover valve or a plurality of changeover valves provided on the oil passage or the plurality of oil passages respectively included in the oil passage group, and that performs changeover between a state in which hydraulic oil recovered from the cylinder flows back to the oil storage tank and a state in which hydraulic oil supplied from the hydraulic power source to the cylinder does not flow back to the oil storage tank, in accordance with a state of hydraulic oil supplied by the hydraulic power source.

DESCRIPTION OF EMBODIMENTS

Embodiment 1

Figure 1:
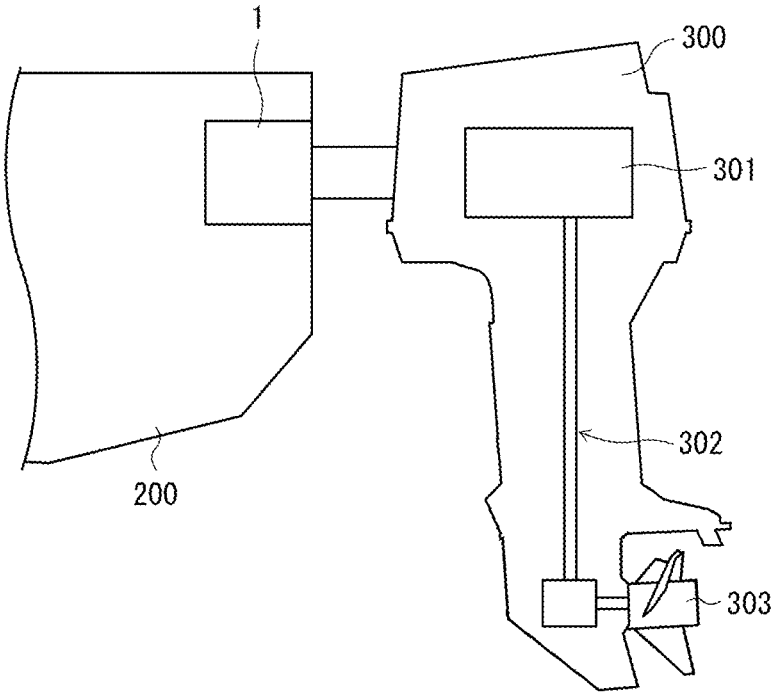
FIG. 1 is a view showing a usage example of a steering device 1 according to Embodiment 1 and a schematic internal configuration of an outboard motor 300.
Figure 2:
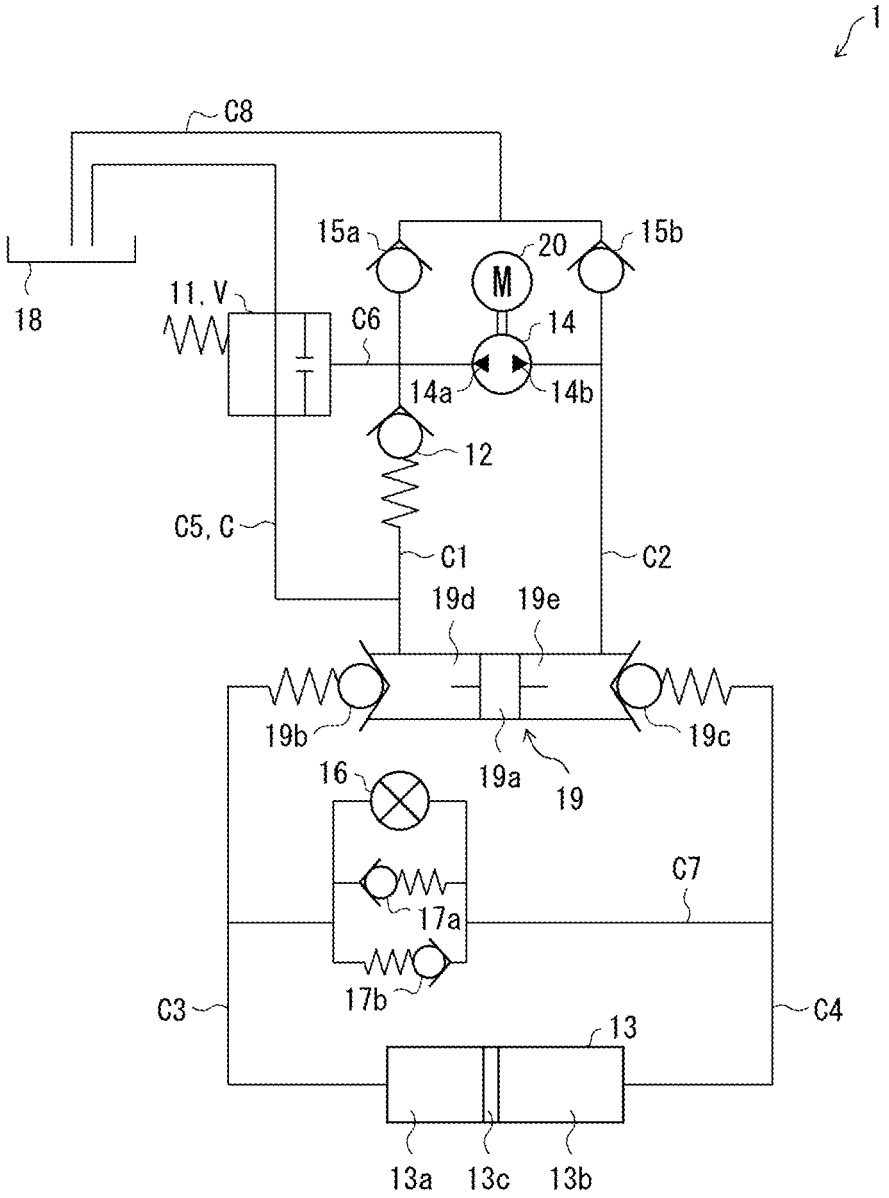
FIG. 2 is a diagram showing an oil-hydraulic circuit of the steering device 1 according to Embodiment 1.
Figure 3:
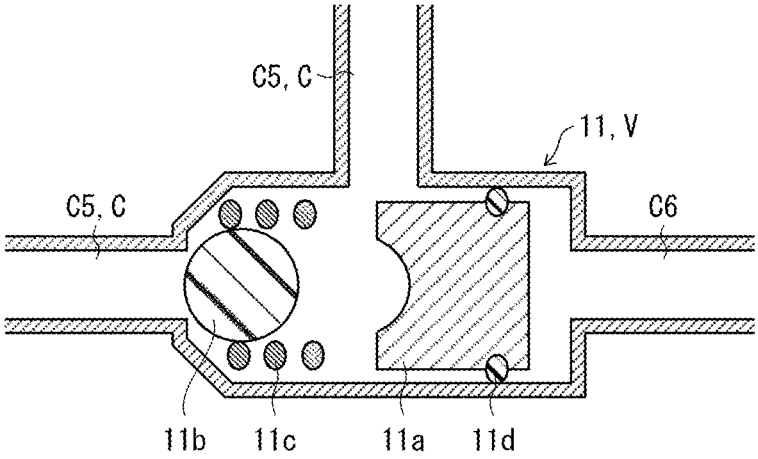
FIG. 3 is a view showing an internal configuration of a changeover valve 11 according to Embodiment 1 in an enlarged manner.

A steering device 1 according to Embodiment 1 will be described with reference to FIG. 1 to FIG. 3.

For example, the steering device according to the present embodiment is a watercraft steering device 1 (which will be hereinafter referred to "steering device 1" simply) used in order to swing an outboard motor left and right. As shown in FIG. 1, the steering device 1 is attached to a rear portion of a hull (body) 200 so as to be connected to an outboard motor 300. The outboard motor 300 is provided with an engine 301, a propeller 303, and a power transmission mechanism 302 which transmits motive power from the engine 301 to the propeller 303.

The steering device 1 swings the outboard motor 300 left and right so that the steering device 1 can control a travelling direction of the hull 200. More specifically, the outboard motor 300 is attached to be connected to a piston 13*c* of a cylinder 13 of the steering device 1 which will be described later. Due to the piston 13*c* moving left and right, the outboard motor 300 is swung left and right accordingly.

As another example, the steering device 1 according to the present embodiment may be used in a configuration in which a rotary shaft of the propeller is provided fixedly to the hull and a rudder is provided at the rear of the propeller in the travelling direction thereof.

Successively, an oil-hydraulic circuit of the steering device 1 will be described with reference to FIG. 2. FIG. 2 is a diagram showing the oil-hydraulic circuit of the steering device 1. As shown in FIG. 2, the steering device 1 is provided with a motor 20, a hydraulic power source 14, the cylinder 13, an oil passage C1 to an oil passage C8, a changeover valve 11, a check valve 12, a check valve 15*a*, a check valve 15*b*, a check valve 17*a*, a check valve 17*b*, a manual valve 16, a main valve 19, and an oil storage tank 18. Hereinafter, the changeover valve 11 may be referred to as first changeover valve, and the check valve 12 may be referred to as first check valve.

The hydraulic power source 14 driven by the motor 20 is a normal/reverse rotation type hydraulic power source provided with a first discharge port 14*a* and a second discharge port 14*b*. The hydraulic power source 14 performs any of a "normal rotation" operation, a "reverse rotation" operation and a "suspension" operation in accordance with control performed by a user. Hydraulic oil is stored in the oil storage tank 18.

The changeover valve 11 is provided on the oil passage C5. The changeover valve 11 is a valve which changes over an open state and a closed state of the oil passage C5 in accordance with a state of hydraulic oil supplied by the hydraulic power source 14. A specific configuration of the changeover valve 11 will be described later.

The check valve 12 is provided on the oil passage C1. The check valve 12 is a valve for controlling an open state and a closed state of the oil passage C1 in accordance with oil pressure of the hydraulic oil supplied by the hydraulic power source 14. A specific configuration of the check valve 12 will be described later.

The cylinder 13 is partitioned into a first chamber 13*a* and a second chamber 13*b* by the piston 13*c*.

The hydraulic power source 14 has the first discharge port 14*a* connected to the first chamber 13*a* through the oil passage C1 and the oil passage C3, and the second discharge port 14*b* connected to the second chamber 13*b* through the oil passage C2 and the oil passage C4.

The main valve 19 is provided with a spool 19*a*, a first check valve 19*b*, and a second check valve 19*c*. The main valve 19 is partitioned into a first shaft chamber 19*d* on the first check valve 19*b* side and a second shaft chamber 19*e* on the second check valve 19*c* side by the spool 19*a*.

The oil passage C1 connects the first discharge port 14*a* with the first shaft chamber 19*d*, and connects the first discharge port 14*a* with the check valve 15*a*. The oil passage C2 connects the second discharge port 14*b* with the second shaft chamber 19*e*, and connects the second discharge port 14*b* with the check valve 15*b*.

The first check valve 19*b* is connected to the first chamber 13*a* through the oil passage C3. On the other hand, the second check valve 19*c* is connected to the second chamber 13*b* through the oil passage C4.

Incidentally, the oil passage C1 and the oil passage C3 connecting the first discharge port 14*a* with the first chamber 13*a* through the main valve 19 may be generically referred to as first oil passage. In addition, the oil passage C2 and the oil passage C4 connecting the second discharge port 14*b* with the second chamber 13*b* through the main valve 19 may be generically referred to as second oil passage.

The changeover valve 11 is connected to the oil passage C5 connecting the oil passage C1 with the oil storage tank 18. The oil passage C6 connects the oil passage C1 between the check valve 12 and the first discharge port 14*a* with the changeover valve 11. The oil passage C5 may be hereinafter referred to as third oil passage, and the oil passage C6 may be hereinafter referred to as fourth oil passage.

Incidentally, the configuration in which the oil passage C1 and the oil storage tank 18 are connected with each other by the oil passage C5 has been described so far. However, the present disclosure is not limited thereto. For example, the configuration may be provided with an oil passage group C including an oil passage or a plurality of oil passages connecting at least one of the oil passage C1 and the oil passage C2 with the oil storage tank 18, and a changeover valve group V including a changeover valve or a plurality of changeover valves provided on the oil passage or the plurality of oil passages respectively included in the oil passage group C.

The manual valve 16, the check valve 17*a* and the check valve 17*b* are connected to the oil passage C7 which connects the oil passage C3 with the oil passage C4. The oil passage C8 connects the check valve 15*a* and the check valve 15*b* with the oil storage tank 18.

When the hydraulic power source 14 still tends to recover hydraulic oil even in a state in which the piston 13*c* has completely slid to the first chamber 13*a* side, the check valve 15*a* supplies hydraulic oil from the oil storage tank 18 to the hydraulic power source 14.

When the hydraulic power source 14 still tends to recover hydraulic oil even in a state in which the piston 13*c* has completely slid to the second chamber 13*b* side, the check valve 15*b* supplies hydraulic oil from the oil storage tank 18 to the hydraulic power source 14.

The manual valve 16 can be open/closed manually. Due to the manual valve 16 which is changed to an open state during maintenance etc. of the steering device 1, hydraulic oil is returned from the first chamber 13*a* to the second chamber 13*b*.

In the case where oil pressure on the cylinder 13 increases suddenly when hydraulic oil is supplied to the oil-hydraulic circuit so that the piston 13*c* slides from the first chamber 13*a* side toward the second chamber 13*b* side, the check valve 17*a* changes itself to an open state. Thus, a load of the oil pressure on the cylinder 13 can be suppressed.

In the case where the oil pressure on the cylinder 13 increases suddenly when the hydraulic oil is supplied to the oil-hydraulic circuit so that the piston 13*c* slides from the second chamber 13*b* side toward the first chamber 13*a* side, the check valve 17*b* changes itself to an open state. Thus, the load of the oil pressure on the cylinder 13 can be suppressed.

(Changeover Valve 11)

Successively, an example of the configuration of the changeover valve 11 will be described with reference to FIG. 3. As shown in FIG. 3, the changeover valve 11 is provided with a plunger 11*a*, a sealing member 11*b*, a spring 11*c*, and an O-ring 11*d*. The O-ring 11*d* is provided on an outer circumferential portion of the plunger 11*a*.

When hydraulic oil is supplied from the first discharge port 14*a* and internal pressure of the oil passage C6 becomes not lower than second pressure, the changeover valve 11 shuts the oil passage C5. More specifically, due to the internal pressure of the oil passage C6 which becomes not lower than the second pressure, the plunger 11*a* slides toward a side where the sealing member 11*b* is provided. Thus, an opening portion of the oil passage C5 against which the sealing member 11*b* is pressed is closed by the sealing member 11*b* so that the oil passage C5 is shut.

When the hydraulic oil is supplied from the first discharge port 14*a* and the internal pressure of the oil passage C6 becomes lower than the second pressure, the changeover valve 11 opens the oil passage C5. More specifically, when the internal pressure of the oil passage C6 becomes lower than the second pressure, the plunger 11*a* is pressed by the spring 11*c* so that the plunger 11*a* moves toward the oil passage C6 side. Thus, since the sealing member 11*b* cannot be pressed against the opening portion of the oil passage C5 anymore, the oil passage C5 is opened.

Incidentally, also in the case where hydraulic oil is supplied from the second discharge port 14*b*, the internal pressure of the oil passage C6 becomes lower than the second pressure. Therefore, the changeover valve 11 opens the oil passage C5 also in the case where the hydraulic oil is supplied from the second discharge port 14*b*.

Thus, the changeover valve 11 performs changeover between a state in which hydraulic oil recovered from the cylinder 13 flows back to the oil storage tank 18, and a state in which hydraulic oil supplied from the hydraulic power source 14 to the cylinder 13 does not flow back to the oil storage tank 18, in accordance with the state of the hydraulic oil supplied by the hydraulic power source 14.

(Check Valve 12)

When hydraulic oil is supplied from the first discharge port 14*a* and the supplied hydraulic oil becomes not lower than first pressure higher than the aforementioned second pressure, the check valve 12 turns to an open state. More specifically, when internal pressure of the oil passage C1 between the check valve 12 and the first discharge port 14*a* becomes not lower than the first pressure, the check valve 12 turns to the open state to open the oil passage C1.

When the hydraulic oil is supplied from the first discharge port 14*a* and the internal pressure of the oil passage C1 between the check valve 12 and the first discharge port 14*a* becomes lower than the first pressure, the check valve 12 turns to a closed state to shut the oil passage C1. Incidentally, also when the hydraulic oil is supplied from the second discharge port 14*b*, the internal pressure of the oil passage C1 between the check valve 12 and the first discharge port 14*a* becomes lower than the first pressure. Therefore, also when hydraulic oil is supplied from the second discharge port 14*b*, the check valve 12 turns to the closed state to shut the oil passage C1.

(Operation Example of Steering Device 1)

Successively, an operation example of the steering device 1 having the aforementioned configuration will be described below.

(Normal Rotation Operation of Hydraulic Power Source 14)

When the hydraulic power source 14 rotates in a normal direction, hydraulic oil is supplied from the second discharge port 14*b* to the second shaft chamber 19*e* through the oil passage C2. Thus, the second check valve 19*c* is opened, and the spool 19*a* moves toward the first check valve 19*b* to thereby open the first check valve 19*b*.

When the second check valve 19*c* is opened, the hydraulic oil supplied to the second shaft chamber 19*e* is supplied to the second chamber 13*b* through the oil passage C4. Due to the hydraulic oil supplied to the second chamber 13*b*, the piston 13*c* slides from the second chamber 13*b* side toward the first chamber 13*a* side.

When the piston 13*c* slides in this manner, the hydraulic oil is supplied from the first chamber 13*a* to the first shaft chamber 19*d* through the oil passage C3 and the first check valve 19*b*. Here, when the hydraulic oil is supplied from the second discharge port 14*b*, the changeover valve 11 turns to an open state to open the oil passage C5, as described above. In addition, when the hydraulic oil is supplied from the second discharge port 14*b*, the check valve 12 turns to a closed state to shut the oil passage C1. Therefore, the hydraulic oil supplied to the first shaft chamber 19*d* is supplied to the oil storage tank 18 through the oil passage C5. Then, the hydraulic oil stored in the oil storage tank 18 is supplied to the hydraulic power source 14 through the oil passage C8.

Thus, in the steering device 1 according to the present embodiment, when the hydraulic power source 14 is rotated in the normal direction, the hydraulic oil in the first chamber 13*a* of the cylinder 13 can be supplied to the oil storage tank 18, and the hydraulic oil in the oil storage tank 18 can be supplied to the second chamber 13*b* of the cylinder 13. Thus, the hydraulic oil in the cylinder 13 can be replaced with the hydraulic oil in the oil storage tank 18.

(Reverse Rotation Operation of Hydraulic Power Source 14)

When the hydraulic power source 14 rotates in a reverse direction, hydraulic oil is supplied from the first discharge port 14*a* to the changeover valve 11 through the oil passage C6, and supplied to the check valve 12 through the oil passage C1. Since the oil passage C6 and the oil passage C1 have been shut by the changeover valve 11 and the check valve 12 respectively, the internal pressure of the oil passage C6 and the internal pressure of the oil passage C1 increase to the second pressure and then increase to the first pressure.

When the internal pressure of the oil passage C6 becomes not lower than the second pressure, the changeover valve 11 turns to a closed state to shut the oil passage C5. In addition, when the internal pressure of the oil passage C1 becomes not lower than the first pressure, the check valve 12 turns to an open state to open the oil passage C1.

When the oil passage C1 is opened, the hydraulic oil supplied to the check valve 12 is supplied to the first shaft chamber 19*d* through the oil passage C1. Thus, the first check valve 19*b* is opened, and the spool 19*a* moves toward the second check valve 19*c* side to open the second check valve 19*c*.

When the first check valve 19*b* is opened, the hydraulic oil supplied to the first shaft chamber 19*d* is supplied to the first chamber 13*a* through the oil passage C3. Due to the hydraulic oil supplied to the first chamber 13*a*, the piston 13*c* slides from the first chamber 13*a* side toward the second chamber 13*b* side.

When the piston 13*c* slides in this manner, the hydraulic oil is supplied from the second chamber 13*b* to the second shaft chamber 19*e* through the oil passage C4 and the second check valve 19*c*, and the hydraulic oil supplied to the second shaft chamber 19*e* is supplied to the hydraulic power source 14.

Thus, in the steering device 1, the hydraulic power source 14 can be controlled to perform the normal rotation operation to thereby replace the hydraulic oil in the cylinder 13 with the hydraulic oil in the oil storage tank 18. Thus, it is possible to (1) suppress an increase of temperature of the hydraulic oil, (2) suppress deterioration of the hydraulic oil, and (3) remove foreign matters in the oil-hydraulic circuit. Accordingly, it is possible to provide the steering device 1 whose operating characteristic hardly changes.

Embodiment 2

A steering device 2 according to Embodiment 2 will be described with reference to FIG. 4 and FIG. 5.

Figure 4:
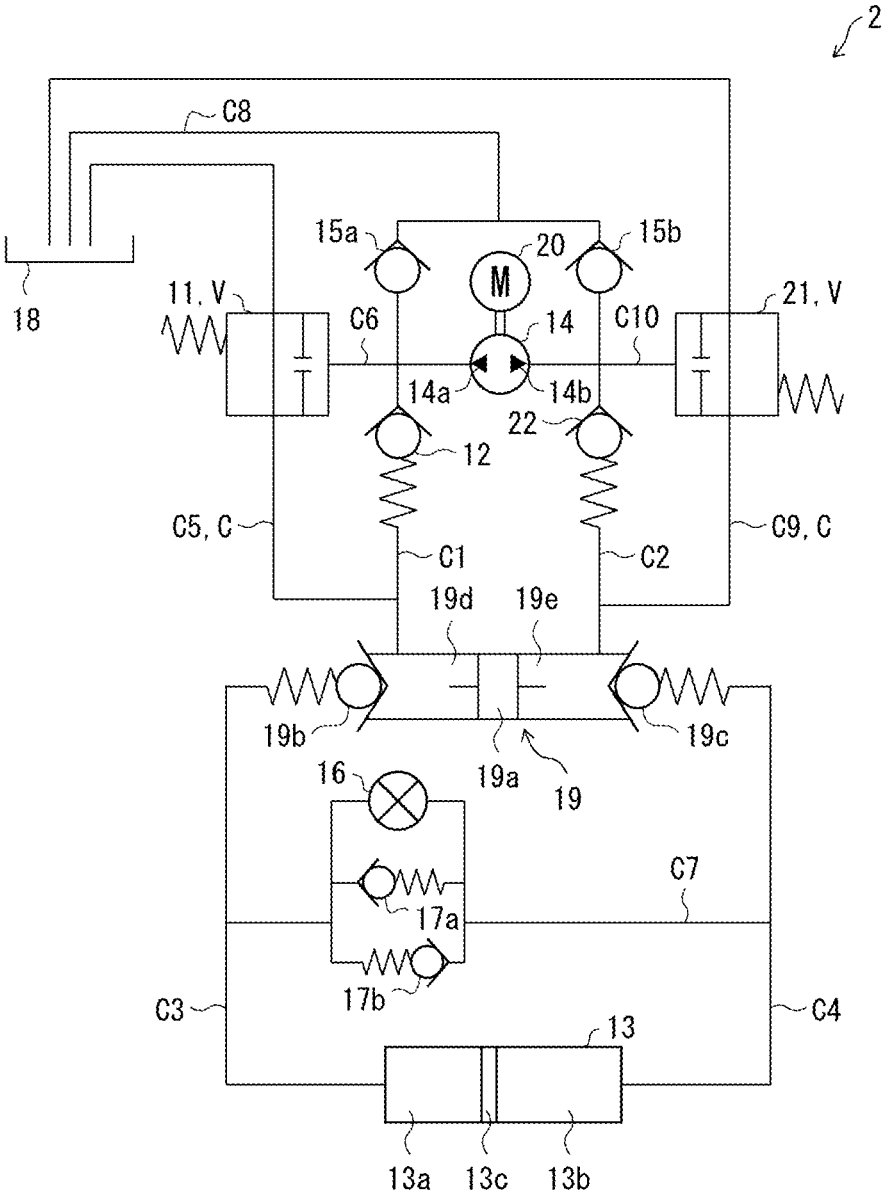
FIG. 4 is a diagram showing an oil-hydraulic circuit of a steering device 2 according to Embodiment 2.
Figure 5:
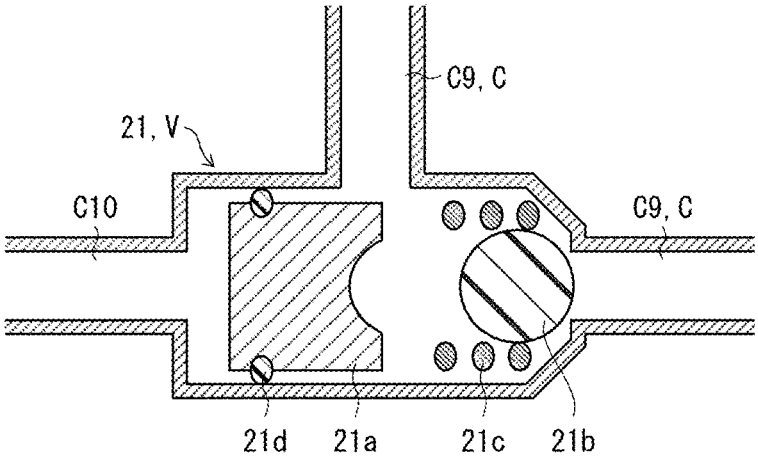
FIG. 5 is a view showing an internal configuration of a changeover valve 21 according to Embodiment 2 in an enlarged manner.

FIG. 4 is a diagram showing an oil-hydraulic circuit of the steering device 2. The steering device 2 is configured to be further provided with a changeover valve 21, a check valve 22, an oil passage C9 and an oil passage C10 in addition to the respective constituents belonging to the aforementioned steering device 1. In the following description, members similar to or the same as the members which have been described above will be referred to by the same signs correspondingly and respectively, and description thereof will be omitted. In addition, the changeover valve 21 may be hereinafter referred to as second changeover valve, the check valve 22 may be hereinafter referred to as second check valve, and the oil passage C10 may be hereinafter referred to as sixth oil passage.

As shown in FIG. 4, the check valve 22 is provided on an oil passage C2. In addition, the oil passage C9 connects the oil passage C2 with an oil storage tank 18. The changeover valve 21 is provided in the oil passage C9 connecting the oil passage C2 with the oil storage tank 18. The oil passage C10 connects the oil passage C2 between the check valve 22 and a second discharge port 14*b* with the changeover valve 21.

Successively, an example of the configuration of the changeover valve 21 will be described with reference to FIG. 5. The changeover valve 21 has a configuration corresponding to that of the changeover valve 11 of the aforementioned steering device 1. For example, the changeover valve 21 can have a configuration formed by reversing the configuration of the changeover valve 11 shown in FIG. 3 horizontally, as shown in FIG. 5. The changeover valve 21 is provided with a plunger 21*a*, a sealing member 21*b*, a spring 21*c*, and an O-ring 21*d*. The O-ring 21*d* is provided on an outer circumferential portion of the plunger 21*a*.

When hydraulic oil is supplied from the second discharge port 14*b* and internal pressure of the oil passage C10 becomes not lower than fourth pressure, the changeover valve 21 shuts the oil passage C9. More specifically, due to the internal pressure of the oil passage C10 which becomes not lower than the fourth pressure, the plunger 21*a* slides toward a side where the sealing member 21*b* is provided. Thus, an opening portion of the oil passage C9 against which the sealing member 21*b* is pressed is closed by the sealing member 21*b* to thereby shut the oil passage C9.

When the hydraulic oil is supplied from the second discharge port 14*b* and the internal pressure of the oil passage C10 becomes lower than the fourth pressure, the changeover valve 21 opens the oil passage C9. More specifically, when the internal pressure of the oil passage C10 becomes lower than the fourth pressure, the plunger 21*a* is pressed by the spring 21*c* so that the plunger 21*a* moves toward the oil passage C10 side. Thus, since the sealing member 21*b* cannot be pressed against the opening portion of the oil passage C9 anymore, the oil passage C9 is opened.

Incidentally, also when hydraulic oil is supplied from a first discharge port 14*a*, the internal pressure of the oil passage C10 becomes lower than the fourth pressure. Therefore, the changeover valve 21 opens the oil passage C9 also when the hydraulic oil is supplied from the first discharge port 14*a*.

The check valve 22 has a configuration corresponding to the check valve 12, i.e. a configuration serving for controlling an opened state and a shut state of the oil passage C2 in accordance with oil pressure of hydraulic oil supplied from a hydraulic power source 14. When the hydraulic oil is supplied from the second discharge port 14*b* and the supplied hydraulic oil becomes not lower than third pressure higher than the aforementioned fourth pressure, the check valve 22 turns to an open state. More specifically, when internal pressure of the oil passage C2 between the check valve 22 and the second discharge port 14*b* becomes not lower than the third pressure, the check valve 22 turns to the open state to open the oil passage C2.

In addition, when the hydraulic oil is supplied from the second discharge port 14*b* and the internal pressure of the oil passage C2 between the check valve 22 and the second discharge port 14*b* becomes lower than the third pressure, the check valve 22 turns to a closed state to shut the oil passage C2. Incidentally, also when hydraulic oil is supplied from the first discharge port 14*a*, the check valve 22 turns to the closed state to shut the oil passage C2.

(Operation Example of Steering Device 2)

An operation example of the steering device 2 having the aforementioned configuration will be described below.

(Normal Rotation Operation of Hydraulic Power Source 14)

When the hydraulic power source 14 rotates in a normal direction, hydraulic oil is supplied from the second discharge port 14*b* to the changeover valve 21 through the oil passage C10 and supplied to the check valve 22 through the oil passage C2. Since the oil passage C10 and the oil passage C2 are shut by the changeover valve 21 and the check valve 22 respectively, the internal pressure of the oil passage C10 and the internal pressure of the oil passage C2 increase to the fourth pressure, and then increase to the third pressure.

When the internal pressure of the oil passage C10 becomes not lower than the fourth pressure, the changeover valve 21 turns to a closed state to shut the oil passage C9. In addition, when the internal pressure of the oil passage C2 becomes not lower than the third pressure, the check valve 22 turns to an open state to open the oil passage C2.

When the oil passage C2 is opened, the hydraulic oil supplied to the check valve 22 is supplied to a second shaft chamber 19*e* through the oil passage C2.

The hydraulic oil supplied to the second shaft chamber 19*e* is supplied to a first shaft chamber 19*d* through an oil passage C4, a cylinder 13, and an oil passage C3 in a manner similar to or the same as the steering device 1 in Embodiment 1.

Here, when the hydraulic oil is supplied from the second discharge port 14*b*, a changeover valve 11 turns to an open state to open an oil passage C5, and a check valve 12 turns to a closed state to shut an oil passage C1, as described above. Therefore, the hydraulic oil supplied to the first shaft chamber 19*d* is supplied to the oil storage tank 18 through the oil passage C5. Next, the hydraulic oil stored in the oil storage tank 18 is supplied to the hydraulic power source 14 through an oil passage C8.

Thus, in the steering device 2, when the hydraulic power source 14 is rotated in the normal direction, hydraulic oil in a first chamber 13*a* of the cylinder 13 can be supplied to the oil storage tank 18, and the hydraulic oil in the oil storage tank 18 can be supplied to a second chamber 13*b* of the cylinder 13. Thus, the hydraulic oil in the cylinder 13 can be replaced with the hydraulic oil in the oil storage tank 18.

(Reverse Rotation Operation of Hydraulic Power Source 14)

When the hydraulic power source 14 rotates in a reverse direction, hydraulic oil is supplied from the first discharge port 14*a* to the changeover valve 11 through an oil passage C6, and supplied to the check valve 12 through the oil passage C1.

When the hydraulic oil is supplied from the first discharge port 14*a* and internal pressure of the oil passage C6 becomes not lower than second pressure, the steering device 2 changes the changeover valve 11 to a closed state to shut the oil passage C5, in a manner similar to or the same as the steering device 1. In addition, when internal pressure of the oil passage C1 becomes not lower than first pressure, the steering device 2 changes the check valve 12 to an open state to open the oil passage C1.

In the steering device 2, the hydraulic oil supplied from the first discharge port 14*a* when the oil passage C1 is opened is supplied to the second shaft chamber 19*e* through the first shaft chamber 19*d*, the oil passage C3, the cylinder 13 and the oil passage C4, in a manner similar to or the same as that in the steering device 1.

Here, when the hydraulic oil is supplied from the first discharge port 14*a*, the changeover valve 21 turns to an open state to open the oil passage C9, and the check valve 22 turns to a closed state to shut the oil passage C2, as described above. Therefore, the hydraulic oil supplied to the second shaft chamber 19*e* is supplied to the oil storage tank 18 through the oil passage C9. Next, the hydraulic oil stored in the oil storage tank 18 is supplied to the hydraulic power source 14 through the oil passage C8.

Thus, when rotating the hydraulic power source 14 in the reverse direction, the steering device 2 can supply the hydraulic oil in the second chamber 13*b* of the cylinder 13 to the oil storage tank 18, and can supply the hydraulic oil in the oil storage tank 18 to the first chamber 13*a* of the cylinder 13. Thus, the hydraulic oil in the cylinder 13 can be replaced with the hydraulic oil in the oil storage tank 18.

Thus, in the steering device 2, the normal rotation operation and the reverse rotation operation of the hydraulic power source 14 are performed repeatedly so that the hydraulic oil in the cylinder 13 can be replaced with the hydraulic oil in the oil storage tank 18. Thus, it is possible to (1) suppress an increase of temperature of the hydraulic oil, (2) suppress deterioration of the hydraulic oil, and (3) remove foreign matters in the oil-hydraulic circuit. Accordingly, it is possible to provide the steering device 2 whose operating characteristic hardly changes.

Embodiment 3

A steering device 3 according to Embodiment 3 will be described with reference to FIG. 6 and FIG. 7.

Figure 6:
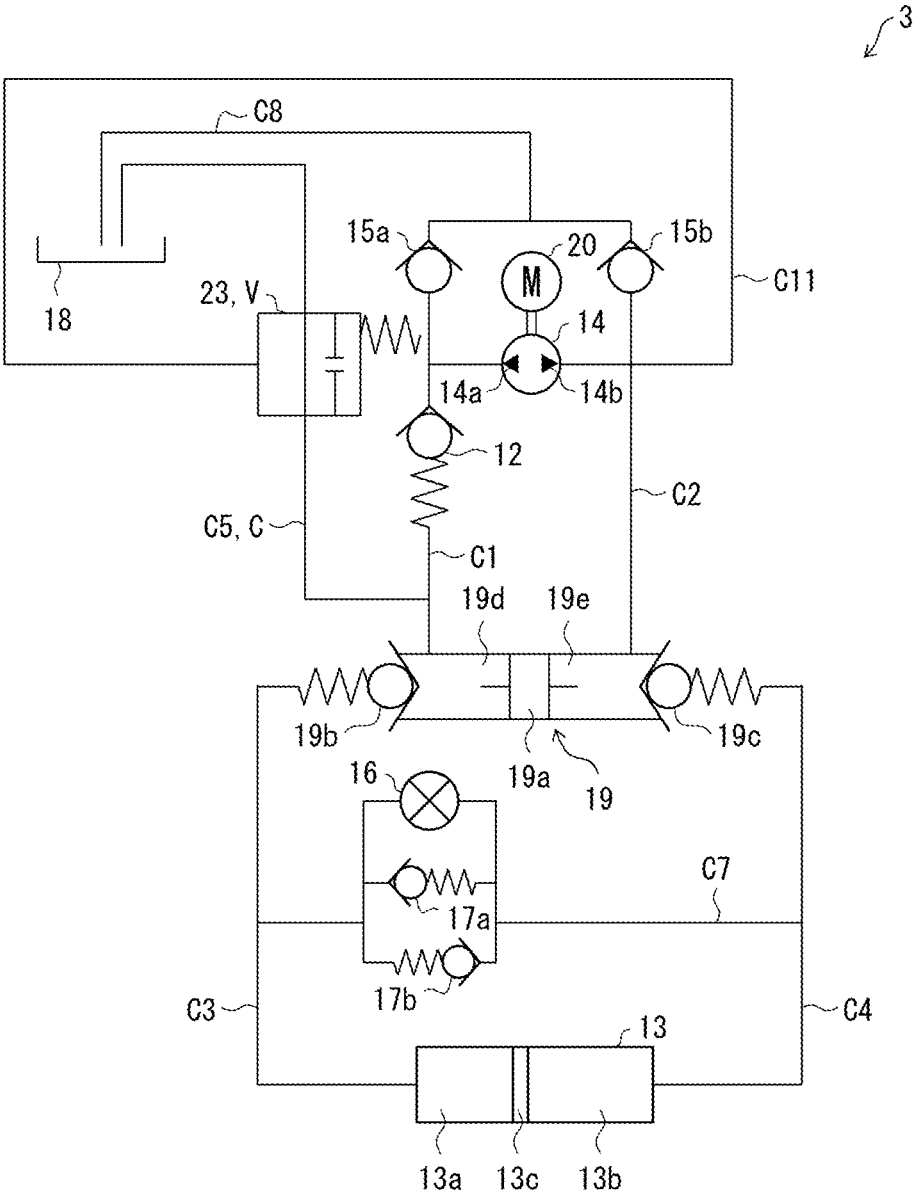
FIG. 6 is a diagram showing an oil-hydraulic circuit of a steering device 3 according to Embodiment 3.

FIG. 6 is a diagram showing an oil-hydraulic circuit of the steering device 3. The steering device 3 is configured to be provided with a changeover valve 23 and an oil passage C11 in place of the changeover valve 11 and the oil passage C6 of the aforementioned steering device 1. In the following description, members similar to or the same as the members which have been described above will be referred to by the same signs correspondingly and respectively, and description thereof will be omitted. In addition, the changeover valve 23 may be hereinafter referred to as third changeover valve, and the oil passage C11 may be hereinafter referred to as seventh oil passage.

As shown in FIG. 6, the oil passage C11 connects an oil passage C2 between a second shaft chamber 19*e* and a second discharge port 14*b* with the changeover valve 23. Incidentally, a similar technical idea to the steering device 3 can be implemented by a configuration in which an oil passage (an oil passage C12 which will be described later) connecting an oil passage C1 between a first shaft chamber 19*d* and a first discharge port 14*a* with a changeover valve (a changeover valve 24 which will be described later) provided on the aforementioned oil passage C9 is provided in place of the oil passage C11, and the aforementioned check valve 22 is provided in place of a check valve 12.

Successively, an example of the configuration of the changeover valve 23 will be described with reference to FIG. 7.

Figure 7:
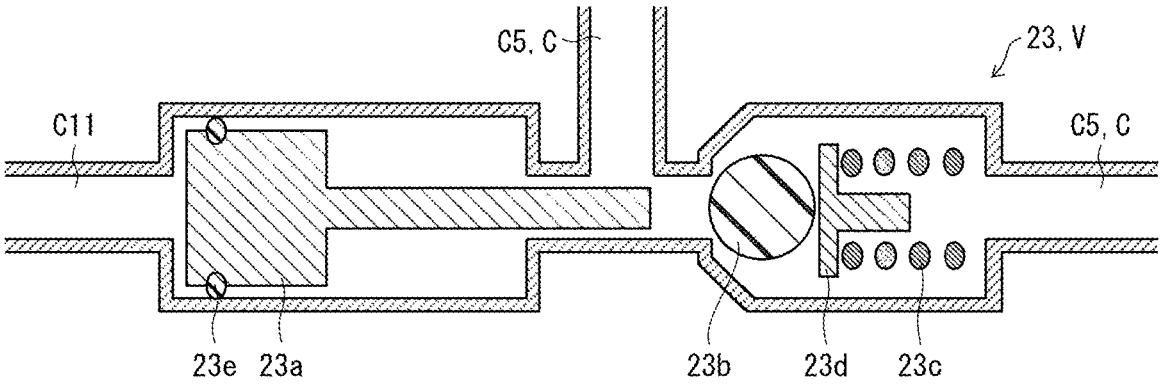
FIG. 7 is a view showing an internal configuration of a changeover valve 23 according to Embodiment 3 in an enlarged manner.

As shown in FIG. 7, the changeover valve 23 is provided with a plunger 23*a*, a sealing member 23*b*, a spring 23*c*, a support member 23*d*, and an O-ring 23*e*. The O-ring 23*e* is provided on an outer circumferential portion of the plunger 23*a*.

When hydraulic oil is supplied from the second discharge port 14*b* and internal pressure of the oil passage C11 becomes not lower than fifth pressure, the changeover valve 23 opens an oil passage C5. More specifically, due to the internal pressure of the oil passage C11 which becomes not lower than the fifth pressure, the plunger 23*a* slides in a direction approaching the sealing member 23*b* to push the sealing member 23*b*. Thus, since the sealing member 23*b* cannot be pressed against an opening portion of the oil passage C5 anymore, the oil passage C5 is opened.

When the hydraulic oil is supplied from the second discharge port 14*b* and the internal pressure of the oil passage C11 becomes lower than the fifth pressure, the changeover valve 23 shuts the oil passage C5. More specifically, when the internal pressure of the oil passage C11 becomes lower than the fifth pressure, the sealing member 23*b* is pressed in a direction closing the opening portion of the oil passage C5 through the support member 23*d* supported by the spring 23*c*. Thus, the opening portion of the oil passage C5 against which the sealing member 23*b* is pressed is closed by the sealing member 23*b* so that the oil passage C5 is shut.

Incidentally, also when hydraulic oil is supplied from a first discharge port 14*a*, the internal pressure of the oil passage C11 becomes lower than the fifth pressure. Therefore, the changeover valve 23 shuts the oil passage C5 also when the hydraulic oil is supplied from the first discharge port 14*a*.

Incidentally, with provision of the O-ring 23*e* on the outer circumferential portion of the plunger 23*a*, the changeover valve 23 blocks movement of hydraulic oil between the oil passage C5 and the oil passage C11.

Thus, the changeover valve 23 is configured to perform changeover between a state in which hydraulic oil recovered from a cylinder 13 flows back to an oil storage tank 18 and a state in which hydraulic oil supplied from a hydraulic power source 14 to the cylinder 13 does not flow back to the oil storage tank 18, in accordance with the state of the hydraulic oil supplied by the hydraulic power source 14.

(Operation Example of Steering Device 3)

An operation example of the steering device 3 having the aforementioned configuration will be described below.

(Normal Rotation Operation of Hydraulic Power Source 14)

When the hydraulic power source 14 rotates in a normal direction, hydraulic oil is supplied from the second discharge port 14*b* to the second shaft chamber 19*e* through the oil passage C2, and hydraulic oil is supplied to the changeover valve 23 through the oil passage C11. Since the oil passage C11 is shut by the changeover valve 23, the internal pressure of the oil passage C11 increases to the fifth pressure.

When the internal pressure of the oil passage C11 becomes not lower than the fifth pressure, the changeover valve 23 turns to an open state to open the oil passage C5.

The hydraulic oil supplied to the second shaft chamber 19*e* is supplied to a first shaft chamber 19*d* through an oil passage C4, the cylinder 13, and an oil passage C3 in a manner similar to or the same as that in the aforementioned steering device 1.

Here, when the hydraulic oil is supplied from the second discharge port 14*b* and the internal pressure of the oil passage C11 becomes not lower than the fifth pressure, the changeover valve 23 turns to the open state to open the oil passage C5, and on the other hand, a check valve 12 turns to a closed state to shut an oil passage C1. Therefore, the hydraulic oil supplied to the first shaft chamber 19*d* is supplied to the oil storage tank 18 through the oil passage C5. Next, the hydraulic oil stored in the oil storage tank 18 is supplied to the hydraulic power source 14 through an oil passage C8.

Thus, in the steering device 3 according to the present embodiment, when the hydraulic power source 14 is rotated in the normal direction, hydraulic oil in a first chamber 13*a* of the cylinder 13 can be supplied to the oil storage tank 18, and the hydraulic oil in the oil storage tank 18 can be supplied to a second chamber 13*b* of the cylinder 13. Thus, the hydraulic oil in the cylinder 13 can be replaced with the hydraulic oil in the oil storage tank 18.

(Reverse Rotation Operation of Hydraulic Power Source 14)

When the hydraulic power source 14 rotates in a reverse direction, hydraulic oil is supplied from the first discharge port 14*a* to the check valve 12 through the oil passage C1. Since the oil passage C1 is shut by the check valve 12, internal pressure of the oil passage C1 increases to first pressure. When the internal pressure of the oil passage C1 becomes not lower than the first pressure, the check valve 12 turns to an open state to open the oil passage C1.

Here, when the hydraulic oil is supplied from the first discharge port 14*a*, the changeover valve 23 shuts the oil passage C5, as described above. Therefore, the hydraulic oil supplied from the first discharge port 14*a* to the check valve 12 is supplied to the first shaft chamber 19*d* through the oil passage C1.

The hydraulic oil supplied to the first shaft chamber 19*d* is supplied to the hydraulic power source 14 through the oil passage C3, the cylinder 13, the oil passage C4, the second shaft chamber 19*e* and the oil passage C2 in a manner similar to or the same as that in the aforementioned steering device 1.

Thus, according to the steering device 3, when the hydraulic power source 14 is operated to rotate in the normal direction, the hydraulic oil in the cylinder 13 can be replaced with the hydraulic oil in the oil storage tank 18. Thus, it is possible to (1) suppress an increase of temperature of the hydraulic oil, (2) suppress deterioration of the hydraulic oil, and (3) remove foreign matters in the oil-hydraulic circuit. Accordingly, it is possible to provide the steering device 3 whose operating characteristic hardly changes.

Embodiment 4

A steering device 4 according to Embodiment 4 will be described with reference to FIG. 8 and FIG. 9.

Figure 8:
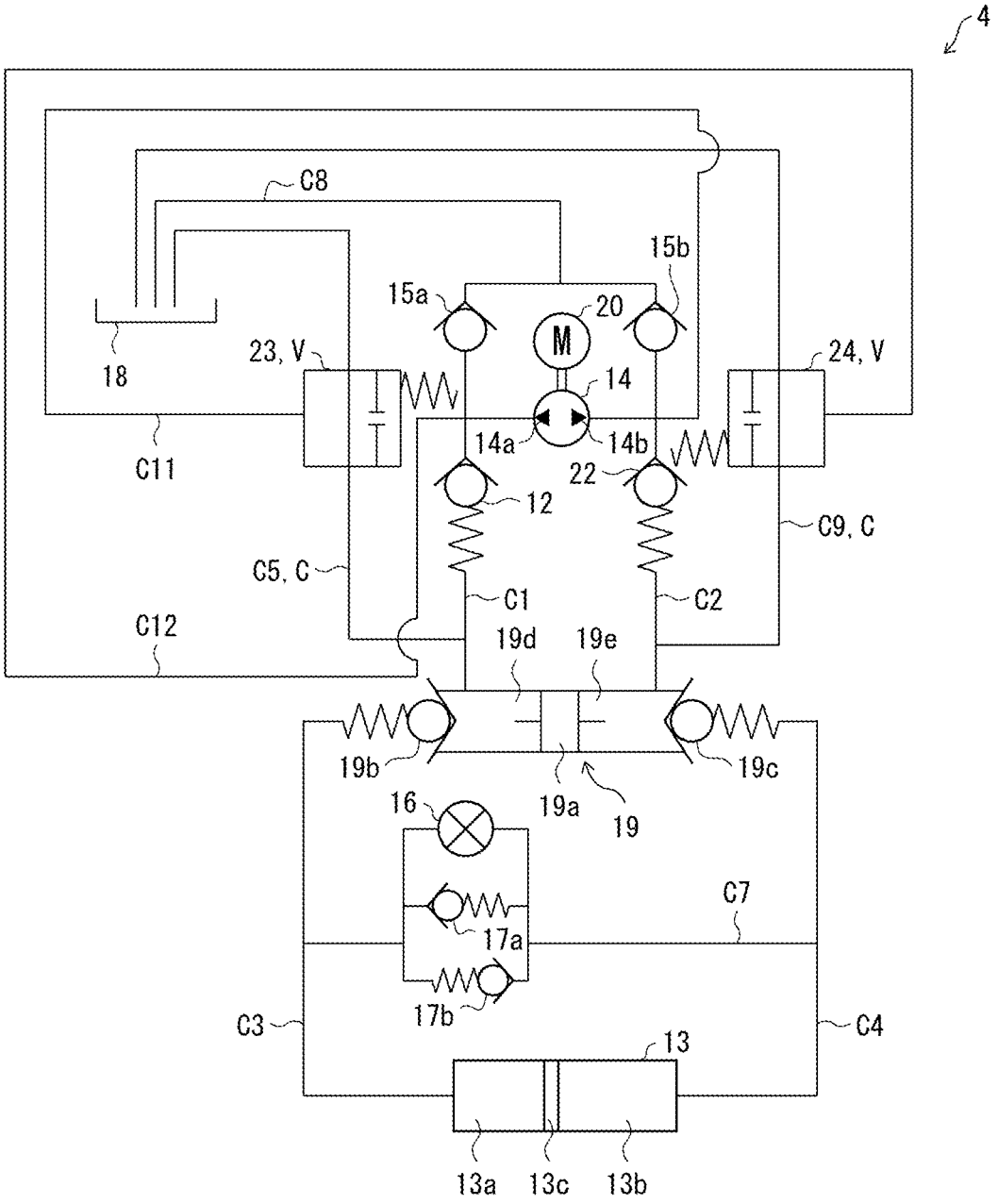
FIG. 8 is a diagram showing an oil-hydraulic circuit of a steering device 4 according to Embodiment 4.
Figure 9:
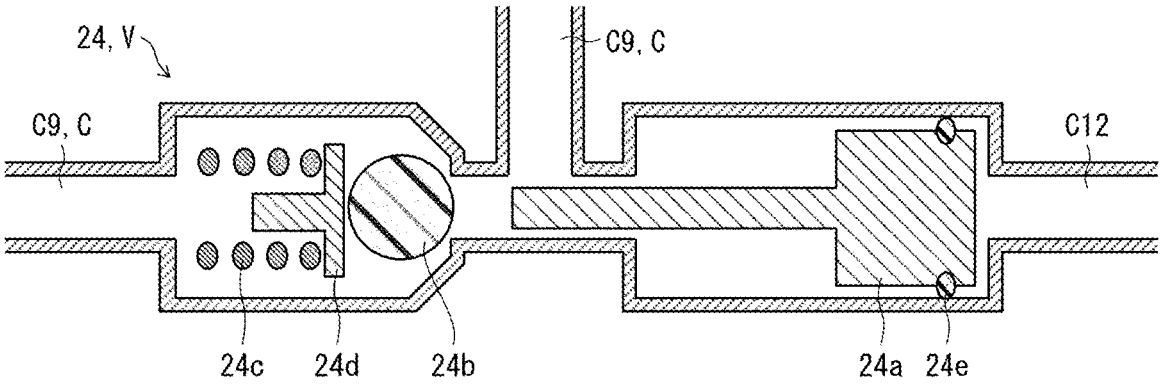
FIG. 9 is a view showing an internal configuration of a changeover valve 24 according to Embodiment 4 in an enlarged manner.

FIG. 8 is a diagram showing an oil-hydraulic circuit of the steering device 4. The steering device 4 is configured to be further provided with a changeover valve 24, a check valve 22, an oil passage C9 and an oil passage C12 in addition to the configuration of the aforementioned steering device 3. In the following description, members similar to or the same as the members which have been described above will be referred to by the same signs correspondingly and respectively, and description thereof will be omitted. In addition, the changeover valve 24 may be hereinafter referred to as fourth changeover valve, and the oil passage C12 may be hereinafter referred to as eighth oil passage.

As shown in FIG. 8, the oil passage C12 connects an oil passage C1 between a check valve 12 and a first discharge port 14*a* with the changeover valve 24.

Successively, an example of the configuration of the changeover valve 24 will be described with reference to FIG. 9. The changeover valve 24 has a configuration corresponding to that of the changeover valve 23 of the aforementioned steering device 3. For example, the changeover valve 24 can have a configuration formed by reversing the configuration of the changeover valve 23 shown in FIG. 7 horizontally, as shown in FIG. 9. The changeover valve 24 is provided with a plunger 24*a*, a sealing member 24*b*, a spring 24*c*, a support member 24*d*, and an O-ring 24*e*. The O-ring 24*e* is provided on an outer circumferential portion of the plunger 24*a*.

When hydraulic oil is supplied from the first discharge port 14*a* and internal pressure of the oil passage C12 becomes not lower than sixth pressure, the changeover valve 24 opens the oil passage C9. More specifically, due to the internal pressure of the oil passage C12 which becomes not lower than the sixth pressure, the plunger 24*a* slides in a direction approaching the sealing member 24*b* to push the sealing member 24*b*. Thus, since the sealing member 24*b* cannot be pressed against an opening portion of the oil passage C9 anymore, the oil passage C9 is opened.

When hydraulic oil is supplied from the first discharge port 14*a* and the internal pressure of the oil passage C12 becomes lower than the sixth pressure, the changeover valve 24 shuts the oil passage C9. More specifically, when the internal pressure of the oil passage C12 becomes lower than the sixth pressure, the sealing member 24*b* is pressed in a direction closing the opening portion of the oil passage C9 through the support member 24*d* supported by the spring 24*c*. Thus, the opening portion of the oil passage C9 against which the sealing member 24*b* is pressed is closed by the sealing member 24*b* so that the oil passage C9 is shut.

Incidentally, also when the hydraulic oil is supplied from a second discharge port 14*b*, the internal pressure of the oil passage C12 becomes lower than the sixth pressure. Therefore, the changeover valve 24 shuts the oil passage C9 also when the hydraulic oil is supplied from the second discharge port 14*b*.

Here, the check valve 12 is configured so that first pressure is higher than the sixth pressure. In addition, the check valve 22 is configured so that third pressure is higher than fifth pressure.

(Operation Example of Steering Device 4)

An operation example of the steering device 4 having the aforementioned configuration will be described below.

(Normal Rotation Operation of Hydraulic Power Source 14)

When a hydraulic power source 14 rotates in a normal direction, hydraulic oil is supplied from the second discharge port 14*b* to the check valve 22 through an oil passage C2, and hydraulic oil is supplied to a changeover valve 23 through an oil passage C11. Since the oil passage C2 and the oil passage C11 are shut by the check valve 22 and the changeover valve 23 respectively, internal pressure of the oil passage C2 and internal pressure of the oil passage C11 increase to the fifth pressure, and then increase to the third pressure.

When the internal pressure of the oil passage C11 becomes not lower than the fifth pressure, the changeover valve 23 turns to an open state to open an oil passage C5. In addition, when the internal pressure of the oil passage C2 becomes not lower than the third pressure, the check valve 22 turns to an open state to open the oil passage C2.

In the steering device 4 according to the present embodiment, when the oil passage C2 is opened, the hydraulic oil supplied to the check valve 22 is supplied to a first shaft chamber 19*d* through the oil passage C2, a second shaft chamber 19*e*, an oil passage C4, a cylinder 13 and an oil passage C3, in a manner similar to or the same as that in the aforementioned steering device 2.

Here, when the hydraulic oil is supplied from the second discharge port 14*b* and internal pressure of the oil passage C1 becomes not lower than the fifth pressure, the changeover valve 23 turns to the open state to open the oil passage C5, and on the other hand, the check valve 12 turns to a closed state to shut the oil passage C1. Therefore, the hydraulic oil supplied to the first shaft chamber 19*d* is supplied to an oil storage tank 18 through the oil passage C5. Next, the hydraulic oil stored in the oil storage tank 18 is supplied to the hydraulic power source 14 through an oil passage C8.

Thus, in the steering device 4, when the hydraulic power source 14 is rotated in the normal direction, hydraulic oil in a first chamber 13*a* of the cylinder 13 can be supplied to the oil storage tank 18, and the hydraulic oil in the oil storage tank 18 can be supplied to a second chamber 13*b* of the cylinder 13. Thus, the hydraulic oil in the cylinder 13 can be replaced with the hydraulic oil in the oil storage tank 18.

(Reverse Rotation Operation of Hydraulic Power Source 14)

When the hydraulic power source 14 rotates in a reverse direction, hydraulic oil is supplied from the first discharge port 14*a* to the check valve 12 through the oil passage C1, and hydraulic oil is supplied to the changeover valve 24 through the oil passage C12. Since the oil passage C1 and the oil passage C12 are shut by the check valve 12 and the changeover valve 24 respectively, the internal pressure of the oil passage C1 and the internal pressure of the oil passage C12 increase to the sixth pressure, and then increase to the first pressure.

When the internal pressure of the oil passage C12 becomes not lower than the sixth pressure, the changeover valve 24 turns to an open state to open the oil passage C9. In addition, when the internal pressure of the oil passage C1 becomes not lower than the first pressure, the check valve 12 turns to an open state to open the oil passage C1.

In the steering device 4 according to the present embodiment, when the oil passage C1 is opened, the hydraulic oil supplied to the check valve 12 is supplied to the second shaft chamber 19*e* through the oil passage C1, the first shaft chamber 19*d*, the oil passage C3, the cylinder 13 and the oil passage C4, in a manner similar to or the same as that in the aforementioned steering device 2.

Here, when the hydraulic oil is supplied from the first discharge port 14*a* and the internal pressure of the oil passage C12 becomes not lower than the sixth pressure, the changeover valve 24 turns to the open state to open the oil passage C9 as described above. On the other hand, the check valve 22 turns to a closed state to shut the oil passage C2. Therefore, the hydraulic oil supplied to the second shaft chamber 19*e* is supplied to the oil storage tank 18 through the oil passage C9. Next, the hydraulic oil stored in the oil storage tank 18 is supplied to the hydraulic power source 14 through the oil passage C8.

Thus, in the steering device 4 according to the present embodiment, when the hydraulic power source 14 is rotated in the reverse direction, the hydraulic oil in the second chamber 13*b* of the cylinder 13 can be supplied to the oil storage tank 18, and the hydraulic oil in the oil storage tank 18 can be supplied to the first chamber 13*a* of the cylinder 13. Thus, the hydraulic oil in the cylinder 13 can be replaced with the hydraulic oil in the oil storage tank 18.

Thus, according to the steering device 4, the normal rotation operation and the reverse rotation operation of the hydraulic power source 14 are performed repeatedly so that the hydraulic oil in the cylinder 13 can be replaced with the hydraulic oil in the oil storage tank 18. Thus, it is possible to (1) suppress an increase of temperature of the hydraulic oil, (2) suppress deterioration of the hydraulic oil, and (3) remove foreign matters in the oil-hydraulic circuit. Accordingly, it is possible to provide the steering device 4 whose operating characteristic hardly changes.

According to an aspect of the present disclosure, it is possible to replace hydraulic oil in an oil-hydraulic circuit with oil in a tank in a configuration using a normal/reverse rotation type hydraulic power source.

The present invention is not limited to the aforementioned embodiments but may be changed variously within the scope of CLAIMS. Any embodiment obtained by suitably combining technical units disclosed in different embodiments respectively is also included in the technical scope of the present invention.

The invention claimed is:

1. A steering device comprising:

a cylinder;

a normal/reverse rotation type hydraulic power source that is provided with a first discharge port and a second discharge port;

an oil storage tank;

a first oil passage that connects a first chamber of the cylinder with the first discharge port of the hydraulic power source;

a second oil passage that connects a second chamber of the cylinder with the second discharge port of the hydraulic power source;

an oil passage group that includes an oil passage or a plurality of oil passages connecting at least one of the first oil passage and the second oil passage with the oil storage tank; and a changeover valve group that includes a changeover valve or a plurality of changeover valves provided on the oil passage or the plurality of oil passages respectively included in the oil passage group, and that performs changeover between a state in which hydraulic oil recovered from the cylinder flows back to the oil storage tank and a state in which hydraulic oil supplied from the hydraulic power source to the cylinder does not flow back to the oil storage tank, in accordance with a state of hydraulic oil supplied by the hydraulic power source, wherein:

the oil passage group includes a third oil passage that connects the first oil passage with the oil storage tank;

the changeover valve group includes a first changeover valve that is provided on the third oil passage;

the steering device further comprises:

a first check valve that turns to an open state in a case where hydraulic oil is supplied from the first discharge port of the hydraulic power source and the supplied hydraulic oil becomes not lower than first pressure, and that turns to a closed state in any other case; and a fourth oil passage that connects the first oil passage between the first check valve and the hydraulic power source with the first changeover valve;

the first check valve is provided on the first oil passage; and the first changeover valve shuts the third oil passage in a case where hydraulic oil is supplied from the first discharge port of the hydraulic power source and internal pressure of the fourth oil passage becomes not lower than second pressure lower than the first pressure, and opens the third oil passage in any other case.

2. The steering device according to claim 1, wherein:

the first changeover valve includes:

a plunger that can slide in accordance with the internal pressure of the fourth oil passage; and a sealing member that shuts the third oil passage when being pressed by the plunger.

3. The steering device according to claim 1, wherein:

the oil passage group includes a fifth oil passage that connects the second oil passage with the oil storage tank;

the changeover valve group includes a second changeover valve that is provided on the fifth oil passage;

the steering device further comprises:

a second check valve that turns to an open state in a case where hydraulic oil is supplied from the second discharge port of the hydraulic power source and the supplied hydraulic oil becomes not lower than third pressure, and that turns to a closed state in any other case; and a sixth oil passage that connects the second oil passage between the second check valve and the hydraulic power source with the second changeover valve;

the second check valve is provided on the second oil passage; and the second changeover valve shuts the fifth oil passage in a case where hydraulic oil is supplied from the second discharge port of the hydraulic power source and internal pressure of the sixth oil passage becomes not lower than fourth pressure lower than the third pressure, and opens the fifth oil passage in any other case.

4. The steering device according to claim 2, wherein:

the oil passage group includes a fifth oil passage that connects the second oil passage with the oil storage tank;

the changeover valve group includes a second changeover valve that is provided on the fifth oil passage;

the steering device further comprises:

a second check valve that turns to an open state in a case where hydraulic oil is supplied from the second discharge port of the hydraulic power source and the supplied hydraulic oil becomes not lower than third pressure, and that turns to a closed state in any other case; and a sixth oil passage that connects the second oil passage between the second check valve and the hydraulic power source with the second changeover valve;

the second check valve is provided on the second oil passage; and the second changeover valve shuts the fifth oil passage in a case where hydraulic oil is supplied from the second discharge port of the hydraulic power source and internal pressure of the sixth oil passage becomes not lower than fourth pressure lower than the third pressure, and opens the fifth oil passage in any other case.

5. The steering device according to claim 3, wherein:

the second changeover valve includes:

a plunger that can slide in accordance with the internal pressure of the sixth oil passage; and a sealing member that shuts the fifth oil passage when being pressed by the plunger.

6. The steering device according to claim 4, wherein:

the second changeover valve includes:

a plunger that can slide in accordance with the internal pressure of the sixth oil passage; and a sealing member that shuts the fifth oil passage when being pressed by the plunger.

7. A watercraft steering device comprising:

a steering device according to claim 1.

8. A steering device comprising:

a cylinder;

a normal/reverse rotation type hydraulic power source that is provided with a first discharge port and a second discharge port;

an oil storage tank;

a first oil passage that connects a first chamber of the cylinder with the first discharge port of the hydraulic power source;

a second oil passage that connects a second chamber of the cylinder with the second discharge port of the hydraulic power source;

an oil passage group that includes an oil passage or a plurality of oil passages connecting at least one of the first oil passage and the second oil passage with the oil storage tank; and a changeover valve group that includes a changeover valve or a plurality of changeover valves provided on the oil passage or the plurality of oil passages respectively included in the oil passage group, and that performs changeover between a state in which hydraulic oil recovered from the cylinder flows back to the oil storage tank and a state in which hydraulic oil supplied from the hydraulic power source to the cylinder does not flow back to the oil storage tank, in accordance with a state of hydraulic oil supplied by the hydraulic power source, wherein:

the oil passage group includes a third oil passage that connects the first oil passage with the oil storage tank;

the changeover valve group includes a third changeover valve that is provided on the third oil passage;

the steering device further comprises:

a first check valve that turns to an open state in a case where hydraulic oil is supplied from the first discharge port of the hydraulic power source, and that turns to a closed state in any other case; and a seventh oil passage that connects the second oil passage with the third changeover valve;

the first check valve is provided on the first oil passage; and the third changeover valve opens the third oil passage in a case where hydraulic oil is supplied from the second discharge port of the hydraulic power source, and shuts the third oil passage in any other case.

9. The steering device according to claim 8, wherein:

the third changeover valve includes:

a plunger that can slide in accordance with internal pressure of the seventh oil passage; and a sealing member that opens the third oil passage when being pressed by the plunger.

10. The steering device according to claim 8, wherein:

the oil passage group includes a fifth oil passage that connects the second oil passage with the oil storage tank;

the changeover valve group includes a fourth changeover valve that is provided on the fifth oil passage;

the steering device further comprises:

a second check valve that turns to an open state in a case where hydraulic oil is supplied from the second discharge port of the hydraulic power source, and that turns to a closed state in any other case; and an eighth oil passage that connects the first oil passage with the fourth changeover valve;

the second check valve is provided on the second oil passage; and the fourth changeover valve opens the fifth oil passage in a case where hydraulic oil is supplied from the first discharge port of the hydraulic power source, and shuts the fifth oil passage in any other case.

11. The steering device according to claim 9, wherein:

the oil passage group includes a fifth oil passage that connects the second oil passage with the oil storage tank;

the changeover valve group includes a fourth changeover valve that is provided on the fifth oil passage;

the steering device further comprises:

a second check valve that turns to an open state in a case where hydraulic oil is supplied from the second discharge port of the hydraulic power source, and that turns to a closed state in any other case; and an eighth oil passage that connects the first oil passage with the fourth changeover valve;

the second check valve is provided on the second oil passage; and the fourth changeover valve opens the fifth oil passage in a case where hydraulic oil is supplied from the first discharge port of the hydraulic power source, and shuts the fifth oil passage in any other case.

12. The steering device according to claim 10, wherein:

the fourth changeover valve includes:

a plunger that can slide in accordance with internal pressure of the eighth oil passage; and a sealing member that shuts the fifth oil passage when being pressed by the plunger.

13. The steering device according to claim 11, wherein:

the fourth changeover valve includes:

a plunger that can slide in accordance with internal pressure of the eighth oil passage; and a sealing member that shuts the fifth oil passage when being pressed by the plunger.

14. A watercraft steering device comprising:

a steering device according to claim 8.

* * * * *